US008069911B2

(12) United States Patent
Hori et al.

(10) Patent No.: US 8,069,911 B2
(45) Date of Patent: Dec. 6, 2011

(54) RADIATOR WITH BUILT-IN OIL COOLER

(75) Inventors: Ryoichi Hori, Tokyo (JP); Hiroyuki Okura, Tokyo (JP); Shiro Nakajima, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 1279 days.

(21) Appl. No.: 11/696,950

(22) Filed: Apr. 5, 2007

(65) Prior Publication Data

US 2007/0246201 A1 Oct. 25, 2007

(30) Foreign Application Priority Data

Apr. 7, 2006 (JP) ..... 2006-106265

(51) Int. Cl.
*F28D 7/10* (2006.01)

(52) U.S. Cl. ..... 165/140; 165/137

(58) Field of Classification Search ..... 165/137, 165/140
See application file for complete search history.

(56) References Cited

U.S. PATENT DOCUMENTS

| | | | | |
|---|---|---|---|---|
| 5,186,245 | A * | 2/1993 | Peters | 165/140 |
| 5,645,125 | A * | 7/1997 | Kroetsch et al. | 165/137 |
| 6,988,541 | B2 * | 1/2006 | Nakajima et al. | 165/140 |
| 6,988,664 | B1 * | 1/2006 | Lee et al. | 235/472.01 |
| 7,188,664 | B2 * | 3/2007 | Fuller et al. | 165/140 |
| 7,516,779 | B1 * | 4/2009 | Marcus | 165/140 |
| 2005/0173099 | A1 | 8/2005 | Nakajima et al. | |

FOREIGN PATENT DOCUMENTS

| | | | |
|---|---|---|---|
| JP | 10-267588 | A | 10/1998 |
| JP | 2001 272195 | A * | 10/2001 |
| JP | 2005-3227 | A | 1/2005 |
| JP | 2005-172270 | A | 6/2005 |
| JP | 2005-308303 | A | 11/2005 |
| JP | 2005-315514 | A | 11/2005 |
| JP | 2005-337529 | A | 12/2005 |

* cited by examiner

*Primary Examiner* — Ljiljana Ciric
(74) *Attorney, Agent, or Firm* — Foley & Lardner LLP

(57) ABSTRACT

A radiator including a core part having a plurality of tubes and fins, a tank fluidically connected with the tank, an oil cooler contained in the tank, the oil cooler being provided with a pair of connecting pipes which fluidically communicate an interior of the oil cooler and penetrate a wall portion of the tank. The wall portion is formed with a projecting reinforcement portion which projects therefrom and is formed at least between the connecting pipes.

10 Claims, 8 Drawing Sheets

RADIATOR WITH BUILT-IN OIL COOLER

BACKGROUND OF THE INVENTION

1. Field of the Invention

The present invention relates to a radiator which is used for a motor vehicle or the like and is equipped with a tank containing an oil cooler for cooling oil of an automatic transmission or others.

2. Description of the Related Art

A conventional radiator equipped with a tank containing an oil cooler is disclosed in Japanese patents laying-open publication No. 2005-315514, No. 2005-337529, No. 2005-308303, No. 2005-172270 and No. 2005-3227. In these conventional radiators, parts of the radiators including the oil cooler and the tank are brazed to each other by heat treatment at the same time, in a state where the oil cooler is contained in the tank and two connecting pipes of the oil cooler pass through a wall portion of the tank to be fixed. Incidentally, in other cases, the oil cooler and the tank are brazed to each other before the heat treatment of other parts of the radiators.

These conventional radiators, however, encounter a problem in that an undesirable deformation of the tank are liable to occur due to a thermal expansion difference caused during the heat treatment, especially in an intermediate portion, sandwiched between a pair of connecting pipes of the oil cooler, of the tank.

FIGS. 10A and 10B show how the tank is deformed after the heat treatment.

In order to easily insert the oil cooler 05, with the connecting pipes P01 and P02 projecting outwardly therefrom, into the tank 03, the tank 03 is usually divided into a first tank body 03A fixed with and a second tank body 03A.

The first tank body 03A is formed with a pair of through-holes for passing the connecting pipes P01 and P02, and the second tank body 03B is formed so as to be coupled with the first tank body 03B. This needs brazing of the connecting pipes P01 and P02 and a wall of the first tank body 03A and another brazing of the first tank body 03A and the second tank body 03B. It is preferable to carry out the both brazing at the same time, because its production time and manufacturing costs can be decreased by removing twice-heating, twice taking in-and-out and cooling the first tank body 03A and the oil cooler 05 after they are brazed.

As shown in FIG. 10A, the oil cooler 05 is temporally assembled with the first tank body 03A in a state where its connecting pipes P01 and P02 penetrate through a wall portion of the first tank body 03A to be fixed. Then the first tank body 03 is temporally coupled with the second tank body 03B. The tank 03 containing the oil cooler 05 is temporally assembled with a core part and others, and then they are placed in a heating furnace to be heated.

In this heat treatment of the radiator, heating temperature and heating hours are usually set, allowing for appropriate ones for mainly those of brazing the core part, the first tank body 03A and the second tank body 03B. Wall portions of the first and second tank bodies 03A and 03B are exposed to an ambient atmosphere in the heating furnace and are directly heated, while the oil cooler 05 is kept out of the direct heat of the heating furnace because the wall portions of the first and second tank bodies 03A and 03B prevent the oil cooler 05 from being directly heated. The temperature of the wall portions rises more rapidly than that of the oil cooler 05, which causes the wall portions to expand with heat, more largely than the oil cooler 05. Accordingly, an intermediate portion 03*a*, sandwiched between the connecting pipes P01 and P02 which penetrate the wall portion of the first tank body 03A, of the wall portion of the first tank body 03A deforms outwardly due to a thermal expansion difference between the first tank body 03A and the oil cooler 05 with the connecting pipes P01 and P02 as shown FIG. 8B. The wall portion is liable to easily deform because of a division into the first and second tank bodies 03A and 03B. The outward deformation of the first tank body 03A may cause a leakage of coolant flowing through the tank 03, deteriorating product quality and reliability of the radiator.

The above-described problem similarly occurs when the oil cooler 05 and the tank 03 are brazed in advance of the heat treatment of the other parts.

It is, therefore, an object of the present invention to provide a radiator containing an oil cooler which overcomes the foregoing drawbacks and can prevent a wall portion, through which connecting pipes of an oil cooler penetrate, of a tank from being deformed beyond permissible limit when the tank body and the oil cooler contained therein are brazed by a heat treatment, improving product quality and reliability of a radiator.

SUMMARY OF THE INVENTION

According to an aspect of the present invention there is provided a radiator including a core part having a plurality of tubes and fins, a tank fluidically connected with the core part, an oil cooler contained in the tank, the oil cooler being provided with a pair of connecting pipes which fluidically communicate with an interior of the oil cooler and penetrate a wall portion of the tank. The wall portion is formed with a projecting reinforcement portion which projects inwardly therefrom, and it is formed in a shape like a rectangle which extends between both side end portions of the oil cooler and at least between the connecting pipes to contact the oil cooler.

Therefore, the radiator of the invention can prevent the wall portion, through which connecting pipes of the oil cooler penetrate, of the tank from being deformed beyond permissible limit because of the projecting reinforcement portion when the tank body and the oil cooler contained therein are brazed by the heat treatment, improving the product quality and reliability of the radiator.

In addition, it can decrease a thermal difference between the tank and the oil cooler due to easier thermal transfer therebetween because of contact of the projecting reinforcement portion and the oil cooler.

Further, the projecting reinforcement portion can increase bending strength of the tank against thermal stress of an intermediate portion of the wall between the tank and the oil cooler because the projecting reinforcement portion extends in a longitudinal direction of the tank.

Preferably, the tank includes a first tank body and a second tank body to be joined with the first tank body to contain the oil cooler therein, the first tank body being provided with the connecting pipes and the projecting reinforcement portion.

Therefore, the oil cooler with the connecting pipes can be easily inserted in and be assembled with the tank.

Preferably, the first tank body has a flat main wall portion provided with the connecting pipes and the projecting reinforcement portion and two side wall portions integrally connected with the main wall portion and bent vertically therefrom, and the second tank body has a flat main wall portion and two side wall portions integrally connected with the main wall portion and bent vertically therefrom. A height of the side wall portions of the first tank body is smaller than a height of the side wall portions of the second tank body.

Therefore, the oil cooler with the connecting pipes can be more easily inserted in and be assembled with the tank.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Figure 1:
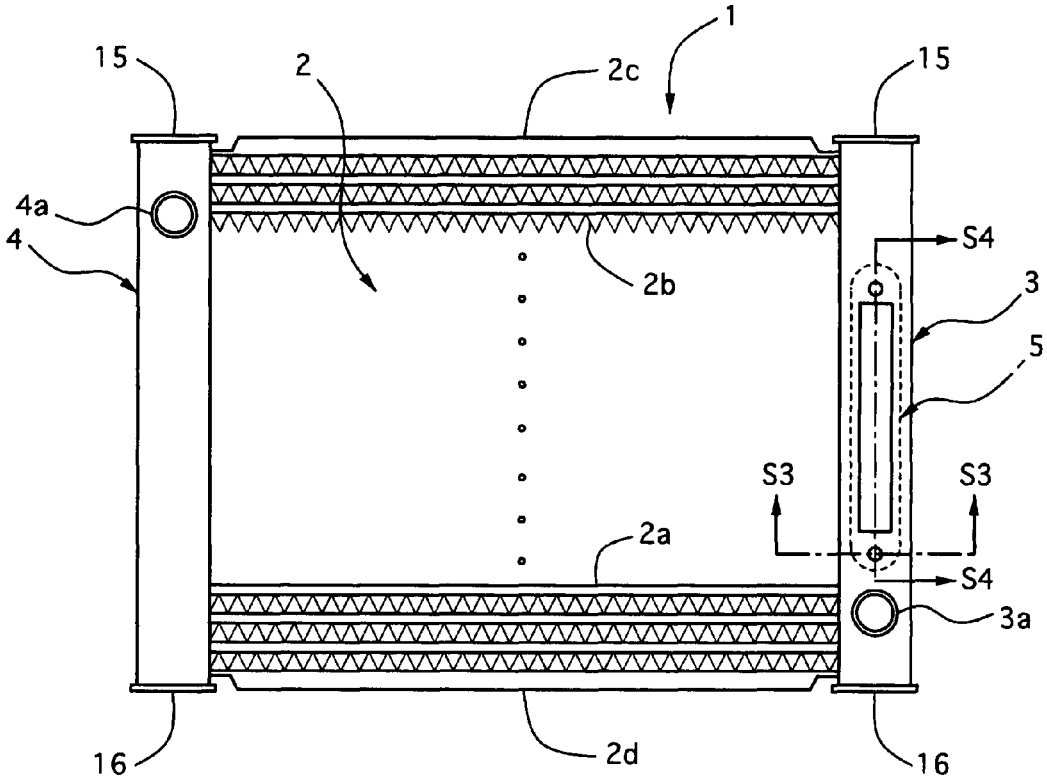
FIG. 1 is a front view showing a radiator, containing an oil cooler, of a first embodiment according to the present invention.

Throughout the following detailed description, similar reference characters and numbers refer to similar elements in all figures of the drawings, and their descriptions are omitted for eliminating duplication.

Referring to FIG. 1, there is shown a radiator 1 of a first embodiment according to the present invention.

The radiator 1 is mounted on a front body of a motor vehicle for example, is connected with a not-shown engine.

The radiator 1 includes a pair of tanks, namely a first tank 3 and a second tank 4, arranged at its both sides and a core part 2 arranged therebetween. The core part 2 has a plurality of flat tubes 2*a* and corrugated fins 2*b*. The tubes 2*a* are connected with the tanks 3 and 4 at their both end portions, respectively, and the fins 2*b* are disposed between the adjacent tubes 2*a*. The top and bottom portions of the core part 2 is reinforced by an upper reinforcement beam 2*c* and a lower reinforcement beam 2*d*, whose both end portions are inserted into and fixed to the first and second tanks 3 and 4.

An inlet-port pipe 4*a* is provided on an upper portion of the second tank 4 for receiving hot coolant from the engine to conduct it into an interior of the tank 4. An outlet-port pipe 3*a* is provided on a lower portion of the first tank 2 for discharging the coolant cooled by the core part 2 toward the engine.

The tank 3 contains an oil cooler 5, which is connected with a not-shown automatic transmission, for example, to cool its oil.

In this embodiment, all parts of the radiator 1 including the core part 2, the first and second tanks 3 and 4 and the oil cooler 5 are made of aluminum, and the parts to be joined with each other are provided with a clad layer, namely a brazing sheet made of brazing filler material, on one-side parts thereof so as to be brazed.

Figure 2:
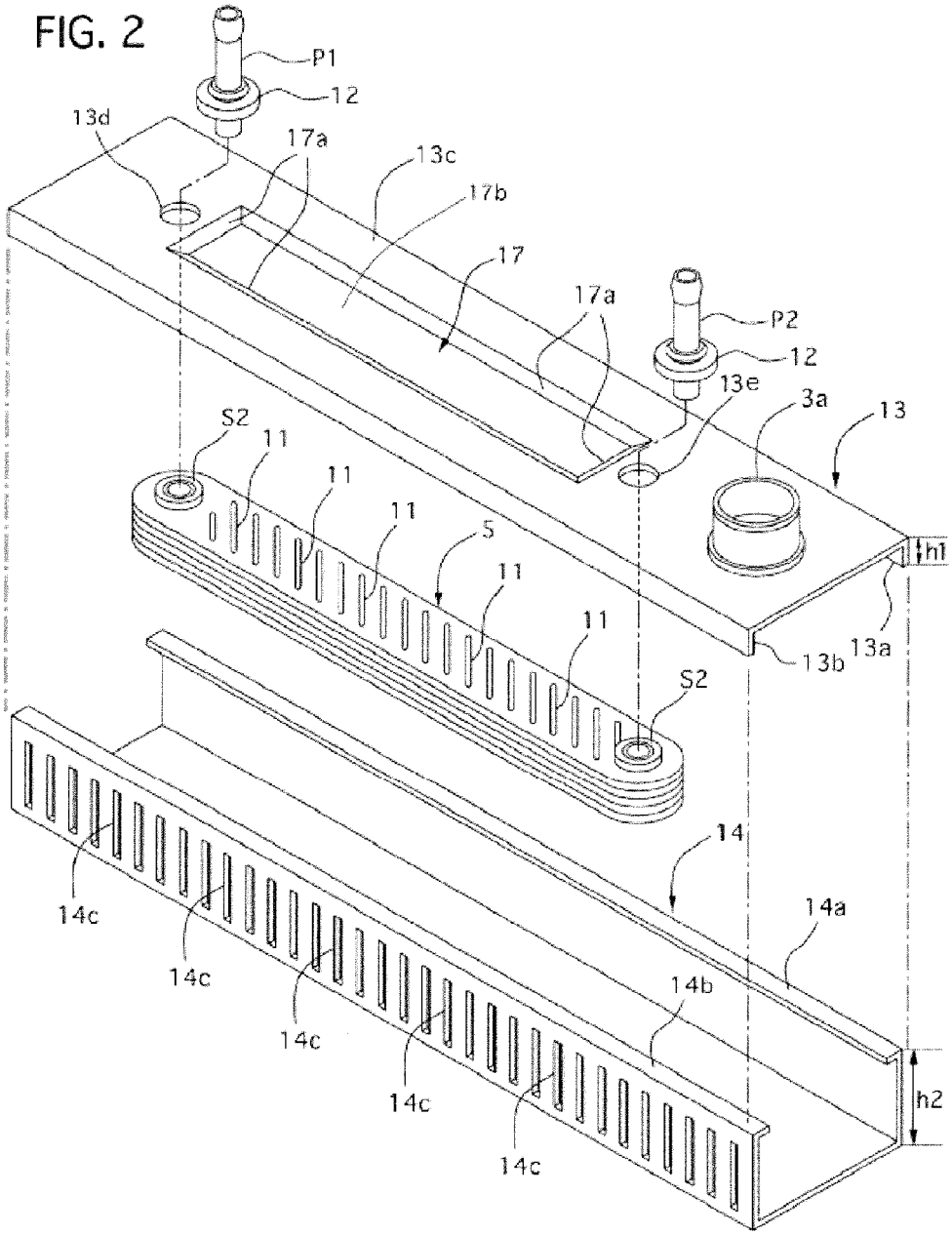
FIG. 2 is an enlarged and exploded perspective view of the oil cooler of the first embodiment and a tank of the radiator.
Figure 3:
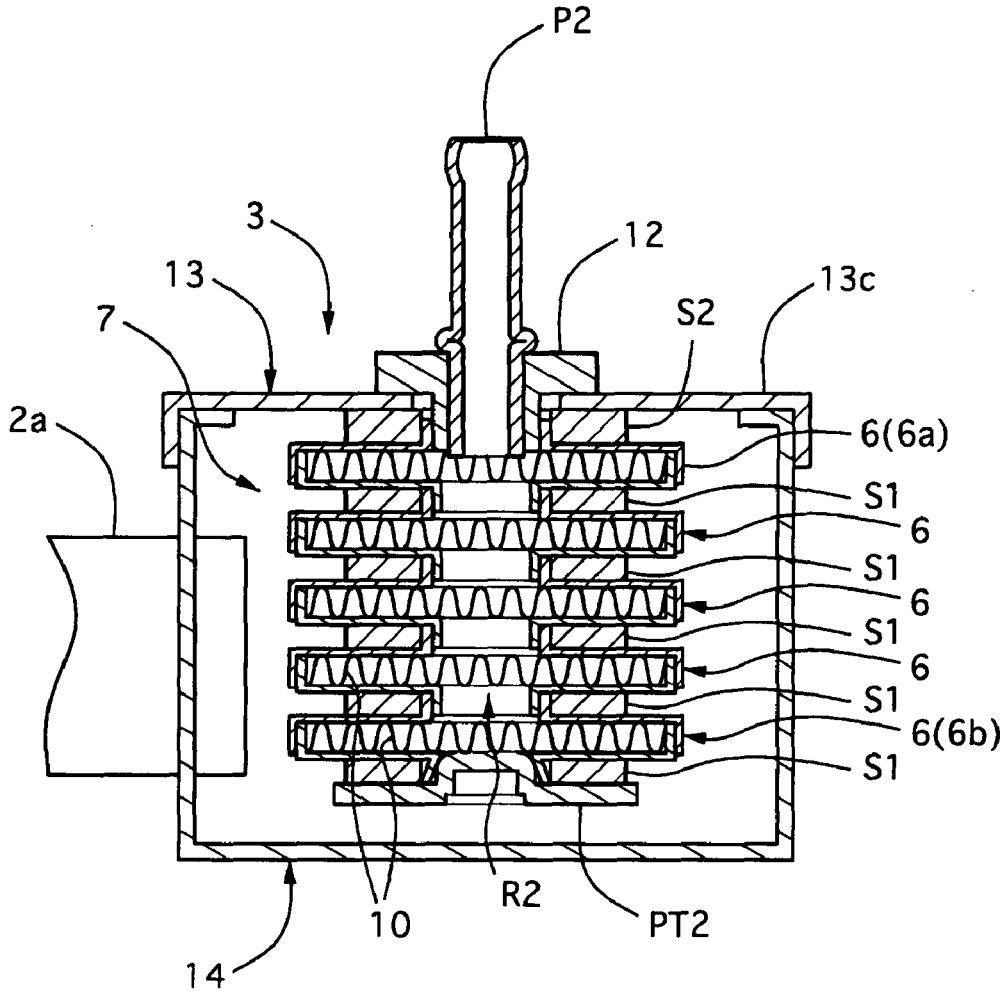
FIG. 3 is a cross sectional view of the oil cooler of the first embodiment, taken along a line S3-S3 in FIG. 1.
Figure 4:
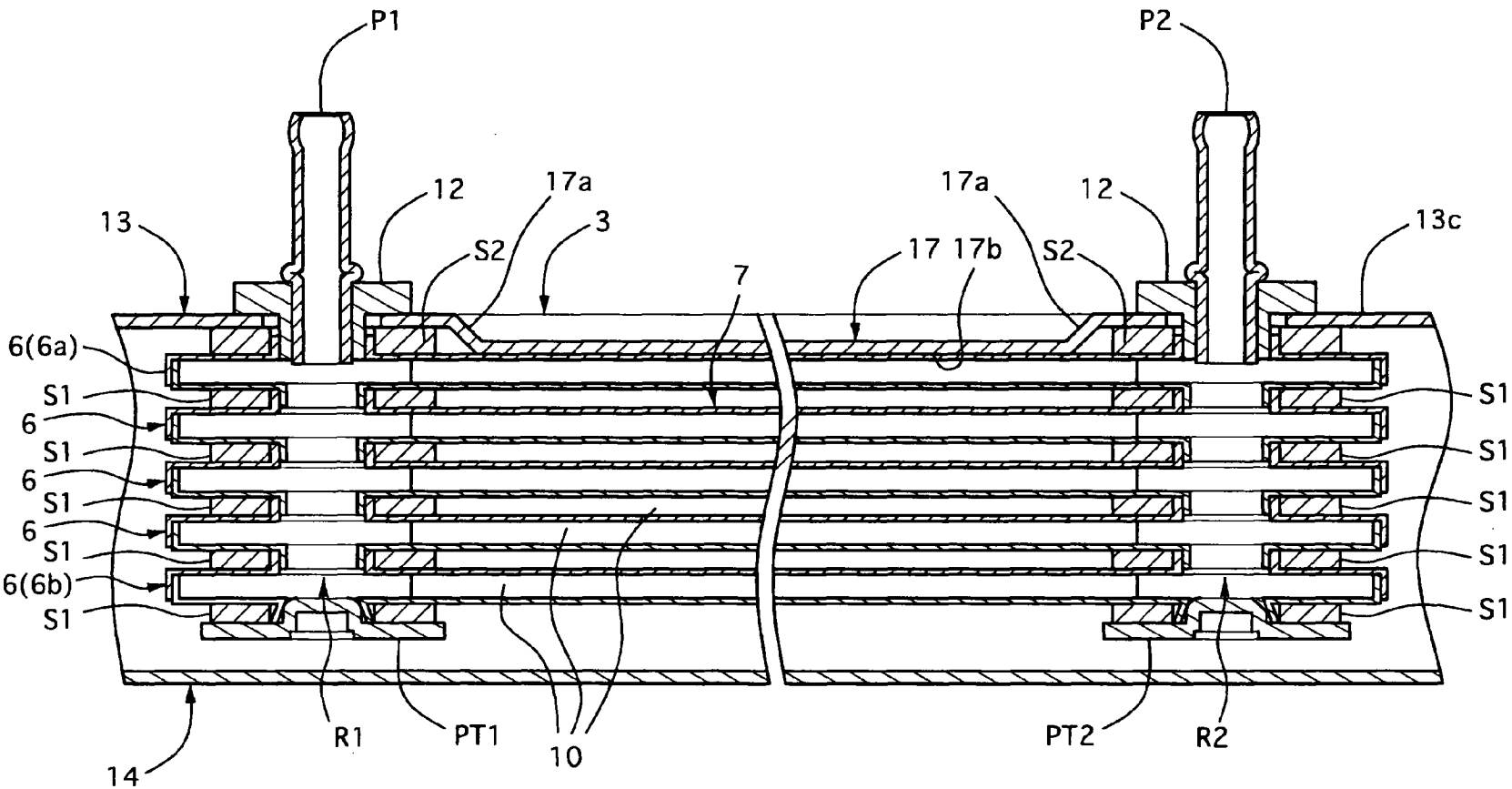
FIG. 4 is a cross sectional view of the oil cooler of the first embodiment, taken along a line S4-S4 in FIG. 1.

Referring to FIGS. 2 to 4, the oil cooler 5 is made by vertically piling up a plurality of elements 6 which sandwich circular spacer sheets S1 between the adjacent elements 6, so that the elements 6 are fluidically connected with each other through a first oil passage R1 and a second oil passage R2 respectively formed at their both end portions as shown in FIG. 4. A first connecting pipe P1 and a second connecting pipe P2 are provided on the elements 6 so that the first connecting pipe P1 projects vertically from an one-side outermost element 6*a* to be communicated with one-side opening of the first oil passage R1, and a second connecting pipe P2 projects vertically from the outermost element 6*a* to be communicated with one-side opening of the second oil passage R2. The other-side outermost element 6*b* is fixed with a first patch plate PT1 and a second patch plate PT2 so that they block out the other-side openings of the first and second oil passages R1 and R2, respectively.

Figure 5A:
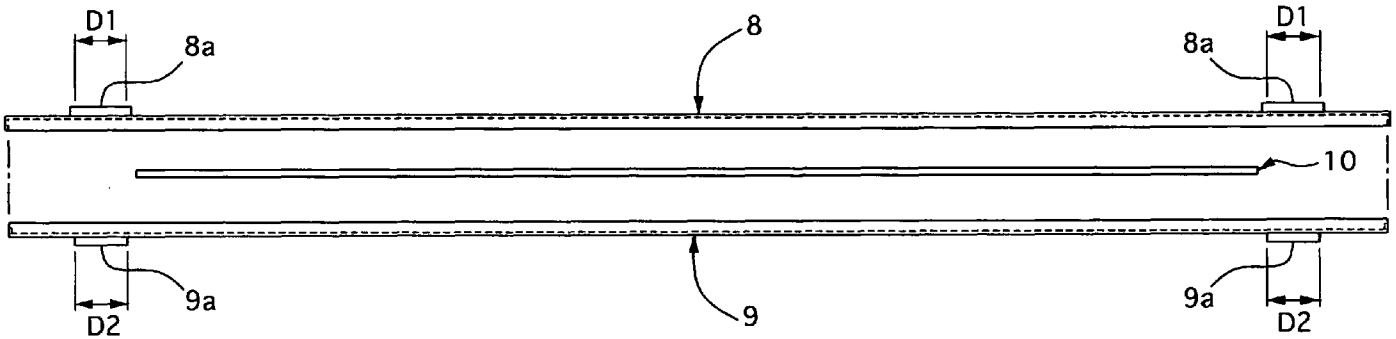
FIG. 5A is an enlarged and exploded view of an element which includes a first shell, a second shell and an inner fin and is used for the oil cooler.
Figure 5B:
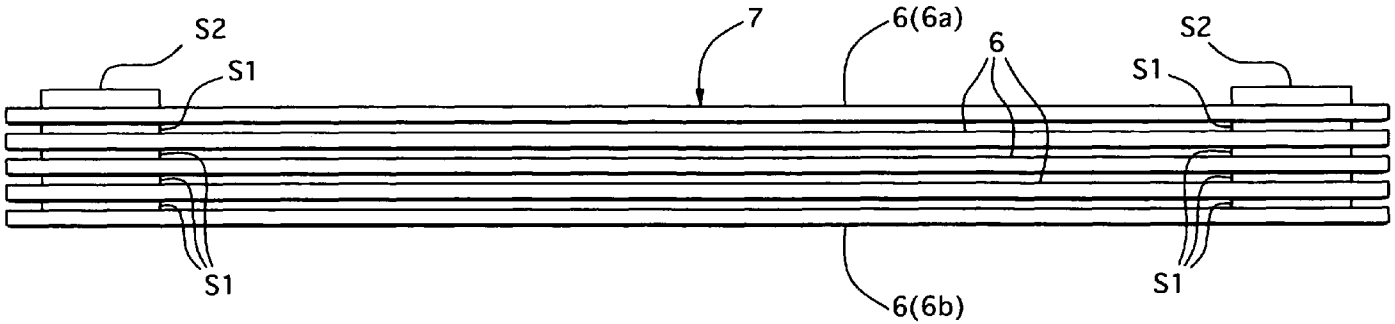
FIG. 5B is a view of the elements which are piled up on and fluidically connected with each other.
Figure 6:
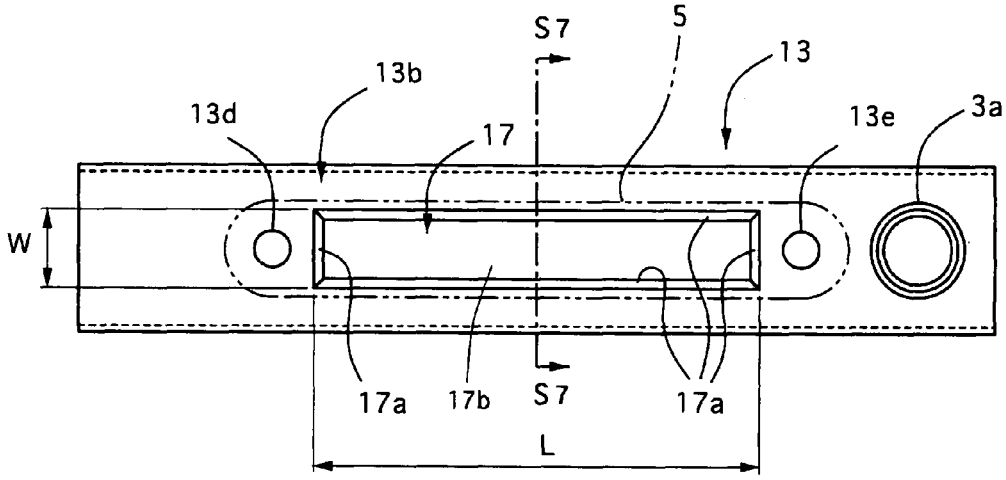
FIG. 6 is a front view of a wall portion of a first tank body constituting the tank shown in FIGS. 1 and 2.

As shown in FIG. 5A, each element 6 consists of a first shell 8, a second shell 9 to be joined with the first shell 8, and a corrugated inner fin 10 disposed in a space, acting as an oil passage connecting the first and second oil passages R1 and R2, formed between the first and second shells 8 and 9.

The first and second shells 8 and 9 are respectively formed with a pair of circular projecting portions 8*a* and 9*a* which outwardly project therefrom by using a burring process, where an inner diameter D1 of the circular projecting portions 8*a* formed on the first shell 8 is formed slightly larger than an outer diameter D2 of the circular projecting portions 9*a* of the second shell 9. Incidentally, the first and second shells 8 and 9 are also formed with a plurality of rimples (or beadings) 11 arranged in an oblique direction on their outer surfaces.

The first shell 8 and the second shell 9 are joined with each other, containing the corrugated inner fin 10 to form the element 6. Then the circular projecting portions 9*a* of the second shell 9 are inserted and fitted into the circular projecting portion 8*a* of the first shell 8 adjacent to the second shell 9 to be joined with each other, so that the elements 6, five ones in this embodiment, are piled up to form a core part 7 of the oil cooler 5. The spacer sheets S1 are disposed between the first shell 8 and the second shell 9 which are adjacent to each other, and around the circular projecting portions 8*a*. The circular projecting portions 8*a* and 9*a* form the first and second oil passages R1 and R2, and these passages R1 and R2 are fluidically communicated with each other through the interiors of the elements 6 as shown in FIG. 4. Note that FIG. 4 is illustrated omitting the corrugated inner fins 10 in the elements 6.

The outermost element 6*a* is respectively provided around its circular projecting portions 8*a* with spacer sheets S2. The spacer sheets S2 are set higher than the spacer sheets S1. The lower portions of the connecting pipes P1 and P2 are inserted through pipe connectors 12 into the circular projecting portions 8*a* of the first shell 8 of the outer most element 6*a*.

The spacer sheets S1 are disposed between the first patch plate PT1 and the second shell 9 of the outermost element 6*b* and PT2 and between the second patch plate PT2 and the second shell 9, respectively.

As shown in FIG. 2, the first tank 3 consists of a first tank body 13 and a second tank body 14. The first tank body 13 includes a main wall portion 13*c* and two side wall portions 13*a* and 13*b* which are bent vertically to the main wall portion 13*c* at both end portions thereof. The main wall portion 13*c* is formed with two through-holes 13*d* and 13*e* for passing through the first and second connecting pipes P1 and P2, respectively. It is also formed near the through-hole 13*e* with a through-hole and is provided with the outlet-port pipe 3*a* at the through-hole.

Figure 7:
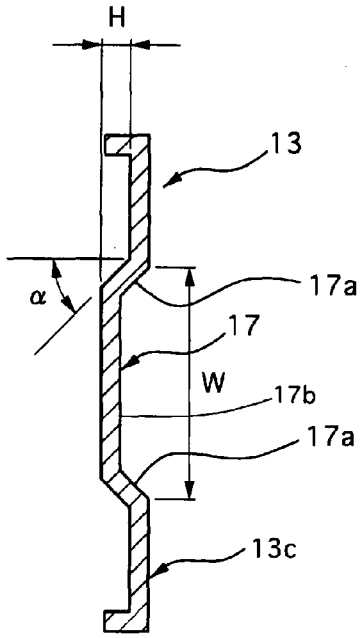
FIG. 7 is a cross sectional view of the wall portion of the first tank body, taken along a line S7-S7 in FIG. 6.
Figure 8:
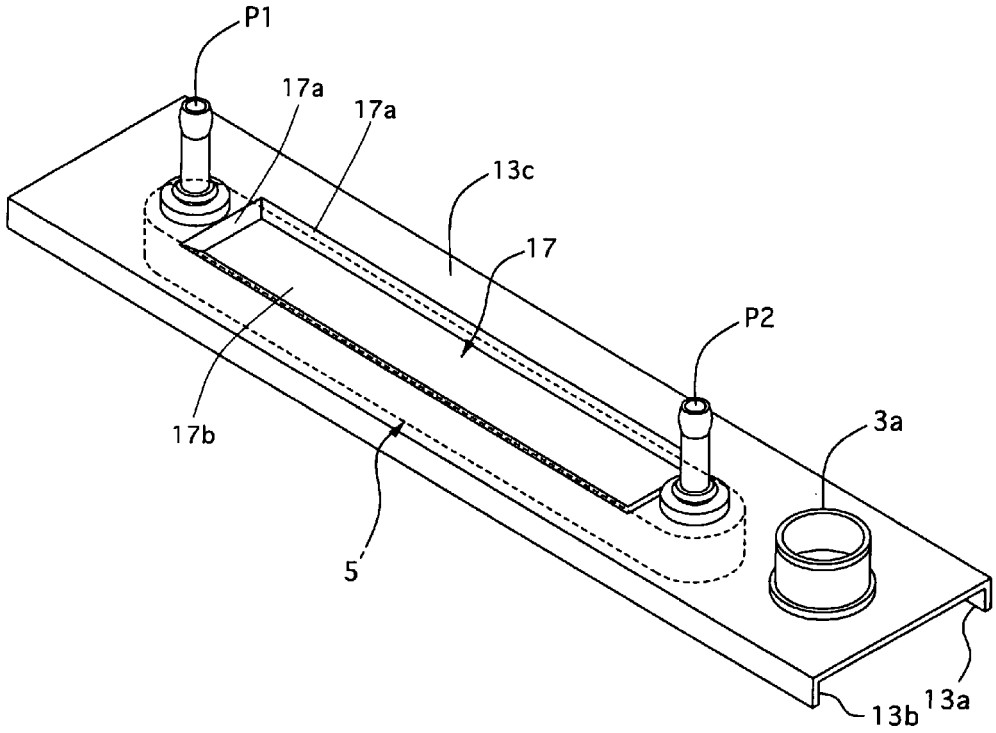
FIG. 8 is a perspective view of the oil cooler and the wall portion of the first tank body when they are heat treated.

As shown in FIGS. 2, 6, 7 and 8, the main wall portion 13*c* of the first tank body 13 is formed between the first and second connecting pipes P1 and P2 with a beading portion 17, which projects inwardly and is shaped in rectangle. The beading portion 17 extends along a line connecting the first and second pipes P1 and P2 (in a longitudinal direction), and consists of four slanted portions 17*a* surrounding and integrally connected with a flat bottom portion 17*b*. Referring to FIG. 7, in this embodiment, a length L, a width W and a projection height H of the beading portion 17 are set as follows: L=approximately 230 mm, W=30 mm and H=2 mm. A projecting angle $\alpha$ of the slanted portion 17*a* is set to be 45°.

Incidentally, the beading portion 17 corresponds to a projecting reinforcement portion of the present invention.

A part of the inner surface of the bottom portion 17*b* is secured on the first shell 8 of the outermost element 6*a* in this embodiment. It is preferable to at least contact them each other, although the securing is not necessary in the invention.

Referring to FIGS. 2 and 3, the second tank body 14 includes a main wall portion 14*d* and two side wall portions 14*a* and 14*b* which are bent vertically to the main wall portion 14*d* at both end portions thereof. The top portions of the side wall portions 14*a* and 14*b* are bent inwardly and in parallel to the main wall portion 14*d*. A width, defined by a distance between the outer surfaces of the side wall portions 14*a* and 14*b*, of the second tank body 14 is slightly smaller than a length, defined by a distance between the inner surfaces of the side wall portions 13*a* and 13*b*, of the first tank body 3. Accordingly, the side wall portions 14*a* and 14*b* of the second tank body 14 can be fitted into the side wall portions of the first tank body 13, so that they can be joined with each other. A height hl of the side wall portions 13*a* and 13*b* of the first tank body 13 is set smaller than that of the side wall portions 14*a* and 14*b* of the second tank body 14, so as to easily assemble the first and second connecting pipes P1 and P2 and the main wall portion 13*a* of the first tank body 13. Note that the oil tank 3 has two openings at its both ends so that the coolant of the radiator 1 can flow therethrough.

The radiator 1 with the oil cooler 5 is manufactured as follows.

The parts of the radiator 1 are formed by using pressing processes.

Then the elements 6 of the oil cooler 5, the spacer sheets S1 and S2, the pipe connectors 12, the patch plates PT1 and PT2, the first tank body 13 and the first and second connecting pipes P1 and P2 are temporally assembled so that the elements 6 are piled up with the spacer sheets S1 and S2 and the first connecting pipes P1 and P2 are inserted into the outermost element 6*a* through the pipe connectors 12, passing through the through-holes 13*d* and 13*e*. These assembled oil cooler 5 and the first tank body 13 are added with the brazing filler material on their joining surfaces and placed into a not-shown heating furnace so that the parts of the oil tank 5 can be brazed and the oil tank 5 and the first tank body 3 can be brazed at the same time. In this heat treatment, a heating temperature and a heating time can be set to be appropriate ones, allowing for mainly those of the core part 7 of the oil cooler 5, so that the temperatures of the parts of the oil cooler 5 and the first tank body 13 can rise smoothly. This brings a favorable brazing thereof.

In the following process, the core part 2, the first and second tanks 3 and 4, and the upper and lower reinforcement beams 2*c* and 2*d* of the radiator 1 are temporally assembled in a state where the first tank body 13 and the second tank body 14 are temporally assembled with each other to contain the oil cooler 5 and are disposed in the first tank 3. They are placed with the brazing filler material in the heating furnace and are heated to be brazed. A heating temperature and a heating time are set to be appropriate ones.

Figure 10A:
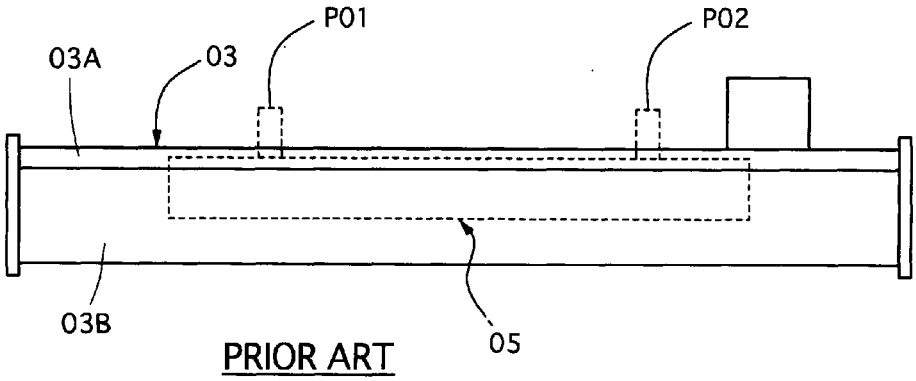
FIG. 10A is a view showing an oil cooler and a tank body of a conventional radiator when they are heat-treated.
Figure 10B:
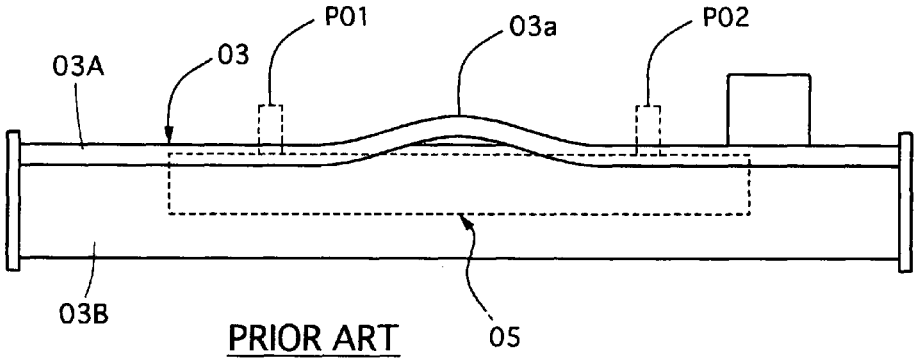
FIG. 10*b* is a view illustrating occurrence of an undesirable deformation of the tank body after the heat treatment.

In the above heat treatments, the beading portion 17 increases strength of the first tank body 13, relative to a first tank body without a beading portion, which tends to be easily deformed because its side wall portions 17*a* and 17*b* are connected only with the main wall portion 17*c* and its height hl is small. In addition, the beading portion 17 extends in the longitudinal direction, which can increase bending strength of the first tank body 13 to prevent its outwardly projecting deformation, as shown in FIG. 10A, of the intermediate portion, sandwiched between the first and second connecting pipes P1 and P2, of the first tank body 13.

The bottom portion of the beading portion 17 are joined with the first shell 8 of the outermost element 6*a*, which promotes thermal transfer between the main wall portion 13*a* and the oil cooler to lessen a thermal difference therebetween. This decreases a deformation difference therebetween, due to thermal expansion, and improve product quality and reliability of the radiator 1.

The operation of the radiator 1 will be described.

The hot coolant outputted from the engine enters the second tank 4 through the inlet-port pipe 4*a*. It flows through the tubes 2*a* toward the first tank 2, being cooled down via the corrugated fin 2*b* and others by air passing through the core part 2 while it flows in the tubes 2*a*. The cooled coolant is discharged through the outlet-port pipe 3*a* to be supplied to the engine.

On the other hand, the hot oil outputted from the automatic transmission enters the first oil passage R1 of the oil cooler 5 through the first connecting pipe P1, and flows toward the second oil passage R2 through the interior space of the elements 6, being cooled down by the coolant in the first tank 3 while it flows in the core part 7 of the oil cooler 5. The cooled oil is discharged through the second connecting pipe P2 to be supplied to the automatic transmission.

Next, a radiator with a tank containing an oil cooler of a second embodiment according to the present invention will be described with reference to the accompanying drawing.

Figure 9:
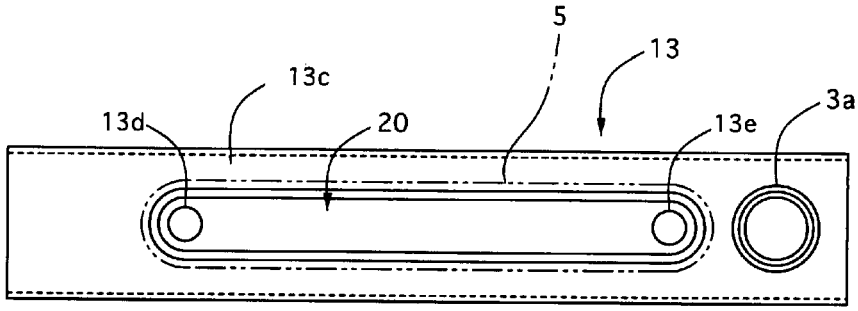
FIG. 9 is a front view of a first tank body which is used for a radiator of a second embodiment according to the present invention and is a modified example of the first tank body shown in FIG. 6.

Referring to FIG. 9, there is shown a first tank body 13 of a tank adapted for the radiator of the second embodiment.

The first tank body 13 is formed with a beading portion 20, which extends in a longitudinal direction thereof and surround a through-hole 13*d* for a first connecting pipe and a through-hole 13*e* for a second connecting pipe. The other parts are constructed similarly to those of the radiator 1 of the first embodiment, and their explanation will be omitted.

Incidentally, the beading portion 20 corresponds to a projecting reinforcement portion of the present invention.

The radiator of the second embodiment can obtain advantages similar to those of the first embodiment.

While there have been particularly shown and described with reference to preferred embodiments thereof, it will be understood that various modifications may be made therein, and it is intended to cover in the appended claims all such modifications as fall within the true spirit and scope of the invention.

The number and cross-sectional shapes of the projecting reinforcement portion, such as the beading portions 17, 18, may be set arbitrarily as long as it is formed between the first and second connecting pipes P1 and P2. For example, the beading portion may project outwardly (in a direction away from the oil cooler 5).

The number of the elements may be set arbitrarily according to a demand for coolability of an oil cooler.

The first and second tanks 3 and 4 may be arranged at an upper side and a lower side of the core part 2 of the radiator.

The two heat treatments described in the embodiment may be carried out at the same time.

The oil cooler 5 is not limited for an automatic transmission, and may be used for other device, an engine for example.

The entire contents of Japanese Patent Applications No. 2006-106265 filed Apr. 7, 2006 are incorporated herein by reference.

What is claimed is:

1. A radiator with a built-in oil cooler comprising:

a core part having a plurality of tubes and fins;

a tank fluidically connected with the core part;

an oil cooler contained in the tank, the oil cooler being provided with a pair of connecting pipes which fluidically communicate with an interior of the oil cooler and penetrate a wall portion of the tank, wherein the wall portion is formed with a projecting reinforcement portion which projects inwardly from the wall portion and is formed in a shape like a rectangle which extends between both side end portions of the oil cooler and at least between the connecting pipes to contact the oil cooler.

2. The radiator according to claim 1, wherein the projecting reinforcement portion has four slanted portions and a flat bottom portion, wherein the four slanted portions surround the flat bottom portion, being integrally connected with the flat bottom portion.

3. The radiator according to claim 2, wherein the flat bottom portion has an inner surface partially secured on an outermost element of the oil cooler.

4. The radiator according to claim 3, wherein the tank includes a first tank body and a second tank body to be joined with the first tank body to contain the oil cooler in the first tank body and the second tank body, the first tank body being provided with the connecting pipes and the projecting reinforcement portion.

5. The radiator according to claim 4, wherein the first tank body has a flat main wall portion corresponding to the wall portion provided with the connecting pipes and the projecting reinforcement portion and two side wall portions integrally connected with the flat main wall portion and bent vertically from the flat main wall portion, and the second tank body has a flat main wall portion and two side wall portions integrally connected with the flat main wall portion and bent vertically from the flat main wall portion of the second tank body, wherein a height of the side wall portions of the first tank body is smaller than a height of the side wall portions of the second tank body.

6. The radiator according to claim 1, wherein the projecting reinforcement portion has a flat bottom portion with an inner surface partially secured on an outermost element of the oil cooler.

7. The radiator according to claim 6, wherein the tank includes a first tank body and a second tank body to be joined with the first tank body to contain the oil cooler in the first tank body and the second tank body, the first tank body being provided with the connecting pipes and the projecting reinforcement portion.

8. The radiator according to claim 7, wherein the first tank body has a flat main wall portion corresponding to the wall portion provided with the connecting pipes and the projecting reinforcement portion and two side wall portions integrally connected with the flat main wall portion and bent vertically from the flat main wall portion, and the second tank body has a flat main wall portion and two side wall portions integrally connected with the flat main wall portion and bent vertically from the flat main wall portion of the second tank body, wherein a height of the side wall portions of the first tank body is smaller than a height of the side wall portions of the second tank body.

9. The radiator according to claim 1, wherein the tank includes a first tank body and a second tank body to be joined with the first tank body to contain the oil cooler in the first tank body and the second tank body, the first tank body being provided with the connecting pipes and the projecting reinforcement portion.

10. The radiator according to claim 9, wherein the first tank body has a flat main wall portion corresponding to the wall portion provided with the connecting pipes and the projecting reinforcement portion and two side wall portions integrally connected with the flat main wall portion and bent vertically from the flat main wall portion, and the second tank body has a flat main wall portion and two side wall portions integrally connected with the flat main wall portion and bent vertically from the flat main wall portion of the second tank body, wherein a height of the side wall portions of the first tank body is smaller than a height of the side wall portions of the second tank body.

* * * * *